US008479723B2

(12) United States Patent
Bibaud et al.

(10) Patent No.: US 8,479,723 B2
(45) Date of Patent: Jul. 9, 2013

(54) LOW-EMISSION FIREPLACE ASSEMBLY

(75) Inventors: André Bibaud, St-Hippolyte (CA); Louise Cléroux, Ste-Anne-des-Lacs (CA)

(73) Assignee: I.C.C. Compagnie de Cheminees Industrielles Inc., Quebec (CA)

( * ) Notice: Subject to any disclaimer, the term of this patent is extended or adjusted under 35 U.S.C. 154(b) by 199 days.

(21) Appl. No.: 12/379,614

(22) Filed: Feb. 25, 2009

(65) Prior Publication Data

US 2009/0223507 A1 Sep. 10, 2009

Related U.S. Application Data

(60) Provisional application No. 61/064,264, filed on Feb. 25, 2008.

(51) Int. Cl.
*F24B 1/18* (2006.01)

(52) U.S. Cl.
USPC ..... 126/500; 126/299 E; 126/504; 126/536; 126/538; 126/552

(58) Field of Classification Search
USPC ..... 126/500, 504, 536, 538, 552
See application file for complete search history.

(56) References Cited

U.S. PATENT DOCUMENTS 1,245,488 A * 11/1917 Millis ..... 126/101
1,520,223 A * 12/1924 Burr ..... 33/518
1,755,771 A * 4/1930 Chambers ..... 126/500
1,768,150 A * 6/1930 Richardson ..... 126/538
3,181,526 A * 5/1965 Walter ..... 126/512
3,227,149 A * 1/1966 Clark ..... 126/4
3,522,798 A * 8/1970 Frazer ..... 126/298
4,054,418 A * 10/1977 Miller et al. ..... 422/171
4,106,693 A * 8/1978 Oliver ..... 126/504
4,136,677 A * 1/1979 Mayes ..... 126/298
4,143,817 A * 3/1979 Oliver ..... 126/504
4,166,447 A * 9/1979 Creim ..... 126/298
4,170,217 A * 10/1979 Mayes ..... 126/523
4,271,817 A * 6/1981 Thompson ..... 126/298
4,360,001 A * 11/1982 Thompson ..... 126/541
4,373,510 A * 2/1983 Smith ..... 126/307 A
4,422,437 A * 12/1983 Hirschey ..... 126/77
4,425,305 A * 1/1984 Retallick ..... 422/180
4,437,451 A * 3/1984 Wysong ..... 126/77
4,466,421 A * 8/1984 Dorsch et al. ..... 126/285 A
4,476,852 A * 10/1984 Lee et al. ..... 126/289
4,688,548 A * 8/1987 Stoughton ..... 126/298

(Continued)

OTHER PUBLICATIONS

Rumford Fireplace Article (www.mcnear.com/products/rumford-fireplaces.html).

(Continued)

*Primary Examiner* — Kenneth Rinehart
*Assistant Examiner* — Jorge Pereiro
(74) *Attorney, Agent, or Firm* — Jacobson Holman PLLC

(57) ABSTRACT

A fireplace assembly is disclosed and includes a smoke chamber, a firebox, a throat in fluid communication with and linking the smoke chamber and the insulated firebox and a divider positioned within said throat and defining a front air channel and a rear air channel within the throat. The fireplace assembly of the present invention offers reductions in particulate emissions when compared to traditional open-burning fireplaces and has comparable particulate emissions to wood stoves and built-in wood stoves.

20 Claims, 5 Drawing Sheets

U.S. PATENT DOCUMENTS

| | | | | |
|---|---|---|---|---|
| 4,691,686 | A | 9/1987 | Alvarez | |
| 4,884,556 | A | 12/1989 | Alden et al. | |
| 5,054,468 | A | 10/1991 | Moon et al. | |
| 5,678,534 | A | 10/1997 | Fleming | |
| 5,816,237 | A | 10/1998 | Fleming | |
| 5,934,268 | A | 8/1999 | Onocki | |
| 6,003,507 | A | 12/1999 | Flick et al. | |
| 6,026,805 | A | 2/2000 | Burch et al. | |
| 6,098,614 | A * | 8/2000 | Fleming | 126/512 |
| 6,123,066 | A | 9/2000 | Fleming | |
| 6,269,809 | B1 | 8/2001 | Fleming | |
| 6,286,502 | B1 | 9/2001 | Moberg | |
| 6,425,390 | B2 | 7/2002 | Campbell et al. | |
| 6,543,440 | B2 | 4/2003 | Moberg | |
| 7,047,962 | B2 | 5/2006 | Henry et al. | |
| 2001/0050078 | A1 * | 12/2001 | Moberg | 126/500 |
| 2002/0104528 | A1 * | 8/2002 | Staller et al. | 126/512 |
| 2003/0034028 | A1 * | 2/2003 | Staller et al. | 126/512 |
| 2008/0156892 | A1 * | 7/2008 | Eberhardt | 237/81 |

OTHER PUBLICATIONS

Rumford Fireplace (http://shannonaldrich1.featuredblog.com/?cat=304); (http://shannonaldrich1.featuredblog.com/files/2008/01/living-room-fireplace-small.JPG).

* cited by examiner

LOW-EMISSION FIREPLACE ASSEMBLY

This application claims the benefit of U.S. provisional application Ser. No. 61/064,264, filed Feb. 25, 2008, and hereby claims the foregoing priority thereof to which it is entitled.

FIELD OF THE INVENTION

This invention relates to wood fireplace designs for installation in residential homes and that are manually fuelled by the homeowner. The invention relates to both site-built masonry fireplaces and pre-fabricated fireplaces. Results have shown that the fireplace particulate emission performance of the present invention is more constant than for traditional fireplaces. This then suggests that this fireplace is going to be more user-friendly in giving lower particulate emissions for homeowners that do not burn wood on a regular basis. This is especially important for this type of fireplace since open burning fireplaces are often associated with consumers who burn wood only on an occasional basis.

BACKGROUND OF THE INVENTION

Rumford Design

The Rumford concept for the design of site built masonry fireplaces has been around for over 200 years. The design was created to reduce heat losses and increase direct radiation from the fireplace. At the time of conception of the original Rumford design, heating of a building was a real challenge and wood burning was the main heating fuel with coal. The original design was efficient in meeting these goals when connected to tall chimneys (25 feet and up) which was very common in city environments. Particulate emissions were not a problem in those days.

The characteristics of a Rumford fireplace construction compared to a more traditional design are:

- A shallow and tall firebox such that the fire can radiate directly over a bigger area in the room.
- Left and right firebox side walls that are open to the room at an angle of 150 degrees compare to 90 degrees for a traditional design. The side walls are going to radiate more heat inside the room with such an open angle.
- A curved breast connecting the fireplace top opening to the throat outlet creating a smooth pathway for the smoke and room air drawn through the fireplace front opening.
- A throat with a reduced cross section.
- A smoke chamber bottom area that is large with respect to the throat area which helps counteract downdraft in the chimney.

These characteristics made the Rumford design well known for improving the heating efficiency of a fireplace by reducing the amount of air drawn through the fireplace opening and by increasing the radiation from the fireplace. The Rumford design is also well known for not spilling smoke inside the room. Tests done in the 1990's also shown that Rumford masonry fireplaces burn cleaner than a traditional masonry fireplace. This reduction in emissions has been associated with the tall firebox which allows the wood to be burned in a tipi-style fire. By having some wood pieces stacked vertically, the volatile combustible gases stay longer in the flames which make the combustion process more efficient.

Today, terra cotta, concrete or steel breast, throat and smoke chamber kits can be purchased and make the construction of a Rumford masonry fireplace easier. However, masonry fireplaces are less common in modern house construction because they cost more to built, require a dedicated foundation and do not offer the same versatility in terms of positioning the fireplace in the house compared to modern pre-fabricated fireplaces.

From the point of view of particulate emissions, which is associated with visible smoke, a Rumford masonry fireplace emits about the same amount of particulates as current modern pre-fabricated open burning fireplaces.

Emission testing done on a particular version of a Rumford masonry fireplace (Buckley Rumford Co) and on pre-fabricated open burning fireplaces based on Washington State protocols have shown they both meet the 7.3 g/kg emission limit with the Rumford emission result at about 7 g/kg.

Other emission testing studies have shown that open wood burning pre-fabricated fireplaces emit in average about 12.4 g/kg of particulate matter when tested with real cordwood with an average burn rate of 4.8 kg/hr.

A new ASTM protocol for open wood burning fireplaces was developed using one of the pre-fabricated fireplace meeting the Washington State protocol. The goal of the ASTM protocol was to have a testing procedure that would simulate real life emission results using dimensional lumber instead of real cordwood. Using dimensional lumber provides more repeatability in the testing. The Washington State pre-fabricated fireplace when tested according to the ASTM protocol emits in average 10.4 g/kg of particulates when burning dimensional lumber. Since no Rumford masonry fireplace has been tested according to the ASTM protocol, one can estimate by extrapolation that the Rumford masonry fireplace meeting the Washington State protocol would also emit about 10.4 g/kg when tested to the ASTM protocol.

Known to the Applicant are U.S. Pat. Nos. 6,286,502 and 6,543,440 by Moberg that describe a fireplace assembly, including a Rumford design, that attempts to reduce particulate emissions, including a firebox with a lintel supporting a breast block across the opening extending between a pair of sidewalls. However, particulate emission performance of this design is not entirely satisfactory.

U.S. Pat. No. 4,884,556 by Alden et al. describes a prefabricated zero clearance fireplace comprising a glass door sized for closing and sealing the fireplace opening in a guillotine manner. However, once again, particulate emission performance of this design is not entirely satisfactory, especially when the door is opened.

Other prior art documents known to the Applicant include U.S. Pat. No. 4,691,686 by ALVAREZ, U.S. Pat. No. 5,054,468 by MOON et al., U.S. Pat. No. 5,678,534 by FLEMING, U.S. Pat. No. 5,816,237 by FLEMING, U.S. Pat. No. 5,934,268 by ONOCKI, U.S. Pat. No. 6,003,507 by FLICK et al., U.S. Pat. No. 6,026,805 by BURCH et al., U.S. Pat. No. 6,123,066 by FLEMING, U.S. Pat. No. 6,269,809 by FLEMING, U.S. Pat. No. 6,425,390 by CAMPBELL et al. and U.S. Pat. No. 7,047,962 by HENRY et al.

Presently, there are regions in the United States that have banned the use of open wood burning fireplaces because of the level of particulate emissions that those appliances emit. There are also many regions that will have to implement particulate reduction regulations in the near future and without the development of new fireplace technologies and/or designs, there is a real possibility that these appliances could be banned all across North America. Environment Canada and some provincial governments have also been looking at how to promote and, in some cases, regulate the burning of wood to reduce the levels of particulate emissions in the atmosphere. Presently, there are clean burning wood stoves and clean burning built-in wood stoves using closed doors available in the marketplace, there is no widely used clean burning open door fireplace.

The main reason why current open burning wood fireplaces emit higher levels of particulates than wood stoves and built-in wood stoves is because the fire is being cooled too much by dilution air drawn through the fireplace opening.

Modern clean burning wood stoves and clean burning built-in wood stoves all use some type of secondary combustion technology to reduce particulate emissions. These technologies cannot be applied to open-burning fireplaces because the temperature of the flue gases is too low to sustain any secondary combustion.

Thus there is still presently a need for a low-emission fireplace assembly that can improve these emission performances.

SUMMARY OF THE INVENTION

An objective of the present invention is to provide a fireplace assembly that satisfies the above-mentioned need.

Accordingly, the present invention provides a fireplace assembly comprising:

an insulated firebox having a front opening;

a smoke chamber positioned over the insulated firebox;

a throat positioned over the insulated firebox, the throat being in fluid communication with the smoke chamber and the insulated firebox, and the throat linking the smoke chamber and the insulated firebox; and a divider positioned within said throat and defining a front air channel and a rear air channel within the throat for air and combustion products rising from the firebox towards the smoke chamber.

The fireplace assembly according to the present invention helps raise fire temperature in the fireplace which in turn helps reduce particulate emissions. The fireplace assembly has some common characteristics with traditional Rumford designs because it is believed that reducing heat losses is the first step in designing a clean wood open-burning fireplace. The fireplace assembly design also focuses on how to increase heat transfer to building occupants. However, because modern single houses often have short chimneys (10 feet and up), the original Rumford design cannot be directly applied to the fireplace assembly according to the present invention.

BRIEF DESCRIPTION OF THE DRAWINGS

These and other objects and advantages of the invention will become apparent upon reading the detailed description and upon referring to the drawings in which.

Figure 1:
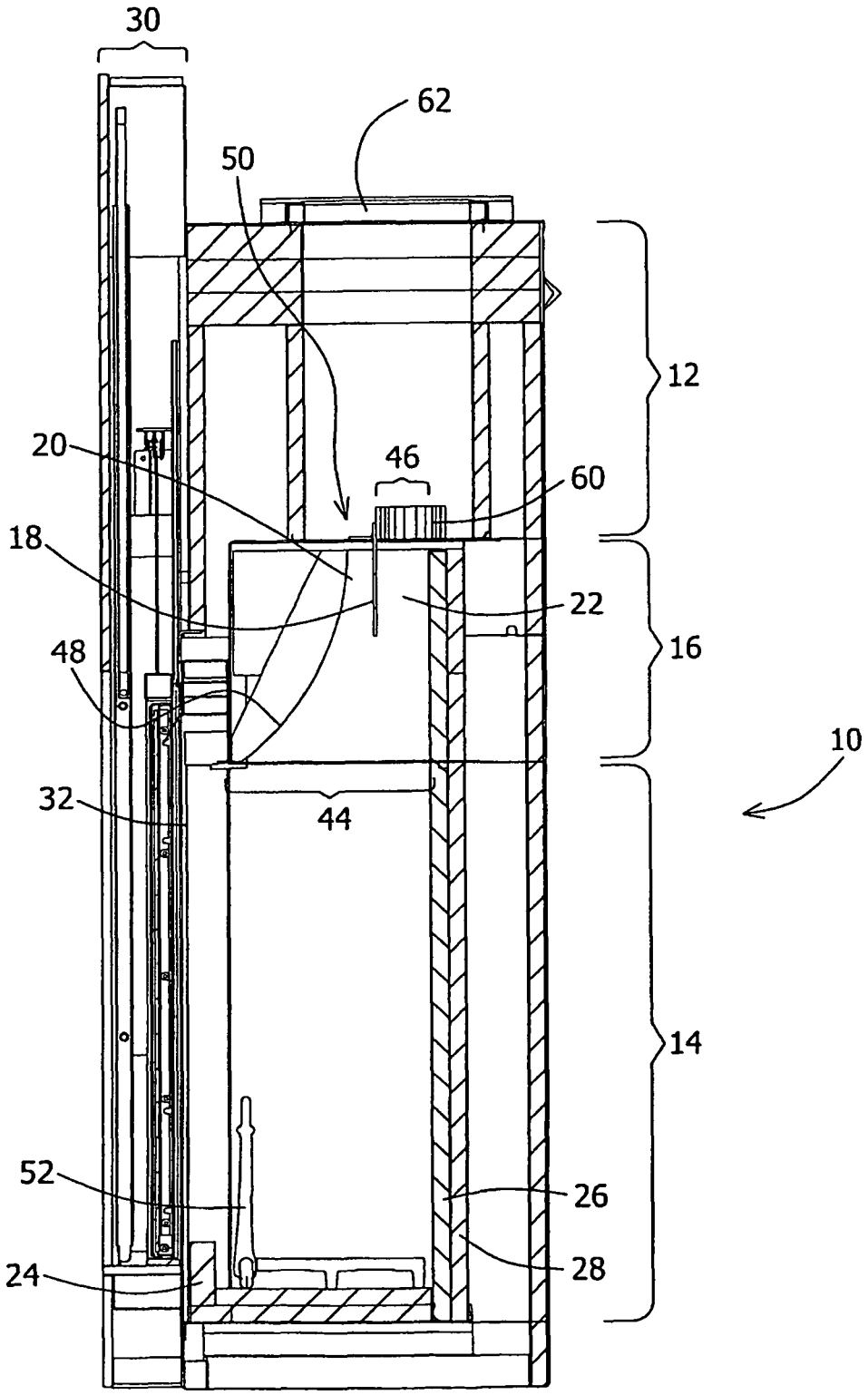
FIG. 1 is a cross-sectional side view of a fireplace assembly according to a preferred embodiment of the present invention.

While the invention will be described in conjunction with an example embodiment, it will be understood that it is not intended to limit the scope of the invention to such embodiment. On the contrary, it is intended to cover all alternatives, modifications and equivalents as may be included.

DESCRIPTION OF A PREFERRED EMBODIMENT

In the following description, similar features in the drawings have been given similar reference numerals and in order to weight down the figures, some elements are not referred to in some figures if they were already identified in a precedent figure.

Figure 3:
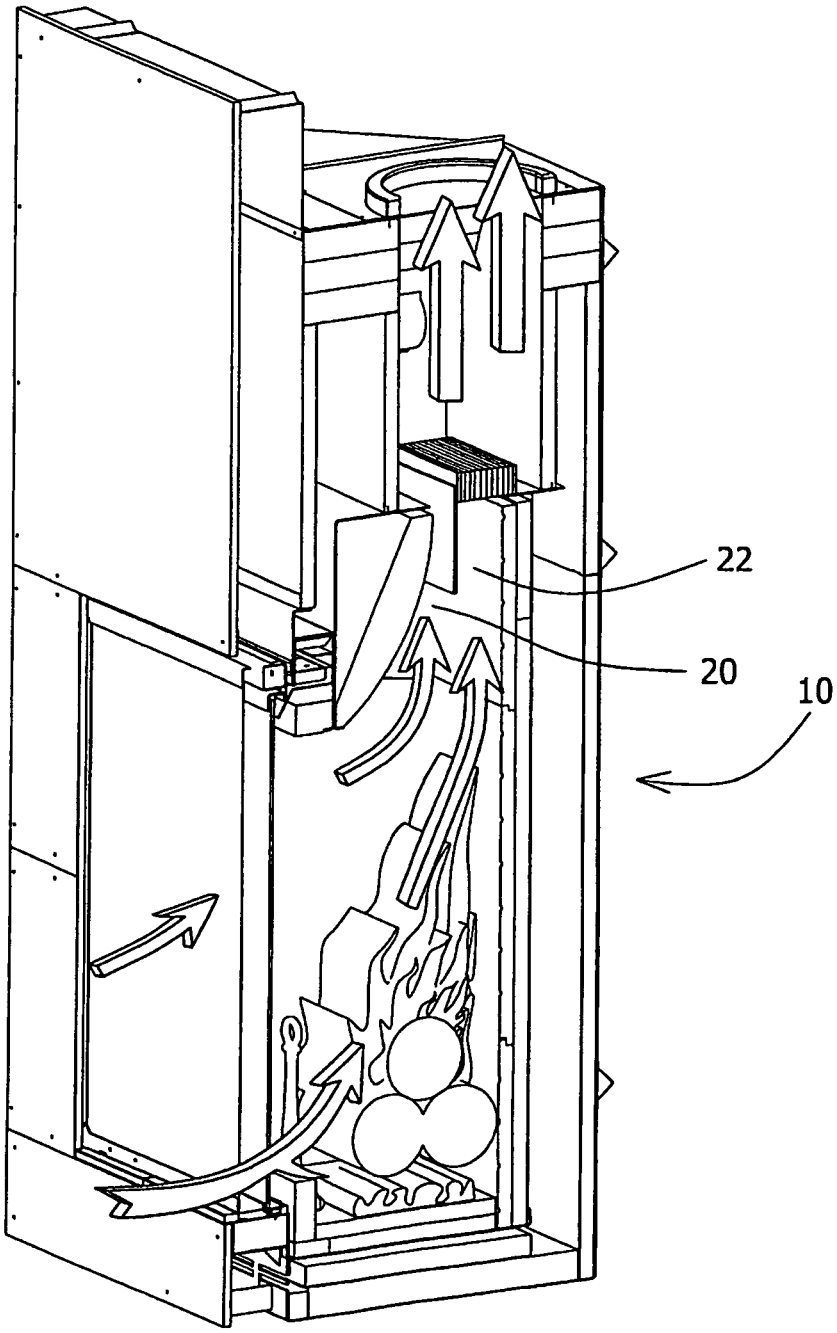
FIG. 3 is a partially cut perspective view of a fireplace assembly according to another preferred embodiment of the present invention, illustrating a fire with its associated airflow.
Figure 4:
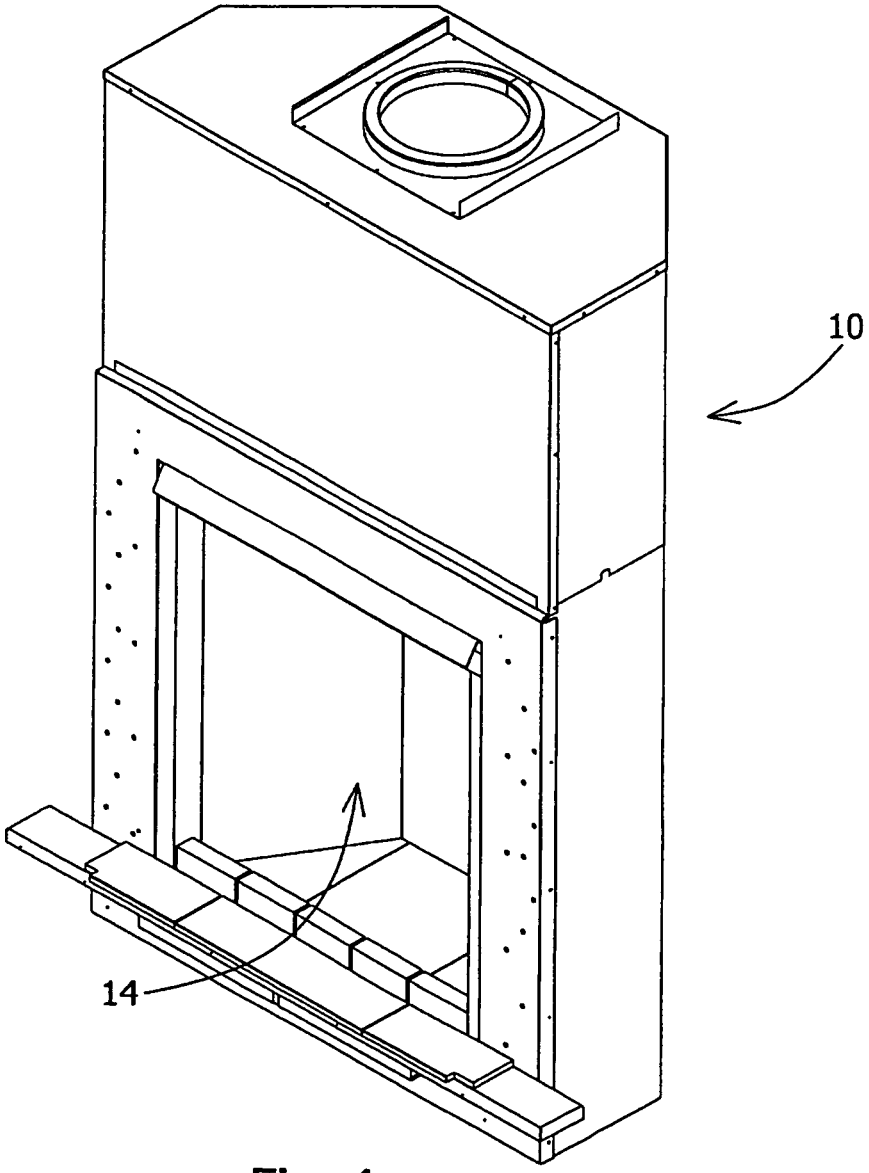
FIG. 4 is a perspective view of a fireplace assembly according to another preferred embodiment of the present invention, with the guillotine door system removed.
Figure 5:
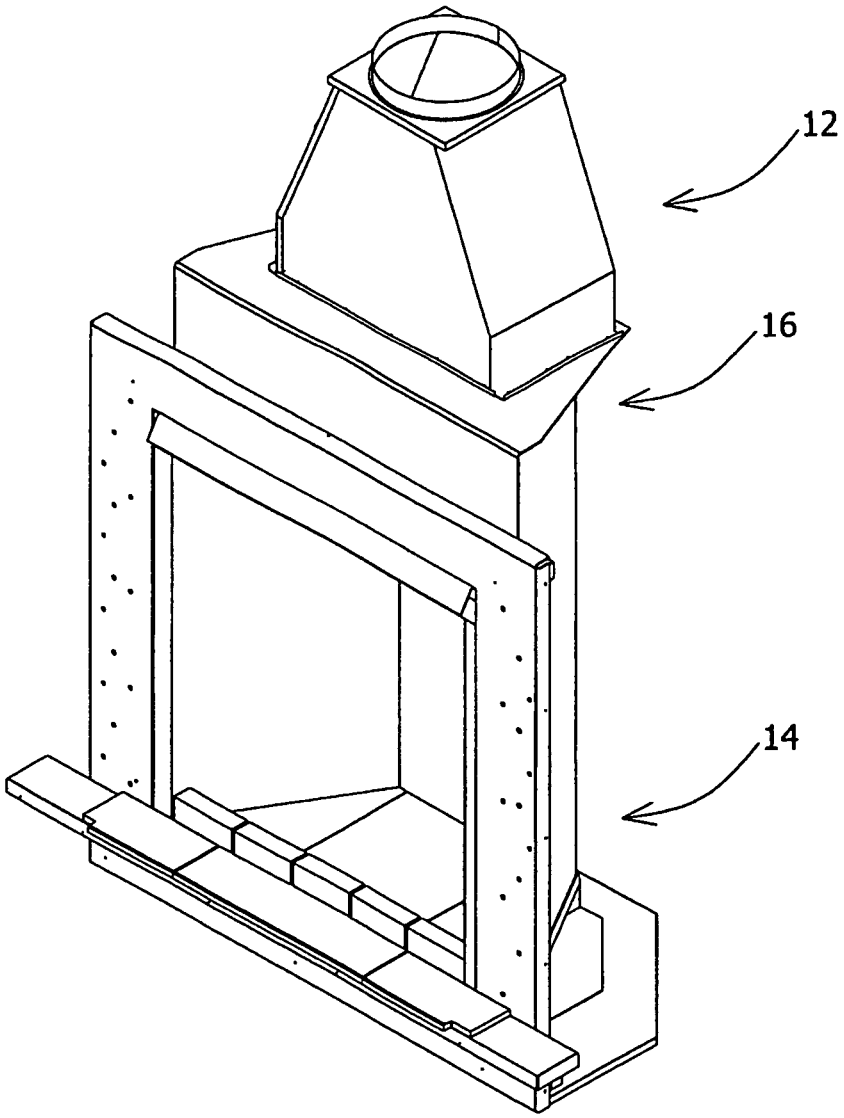
FIG. 5 is a perspective view of inside components of the fireplace assembly according to another preferred embodiment of the present invention, including the firebox and facing, smoke chamber and refractory bricks.

As shown in FIG. 1, the present invention provides a fireplace assembly 10. The fireplace assembly 10 comprises an insulated firebox 14 having a front opening, a smoke chamber 12 positioned over the insulated firebox 14 and a throat 16 positioned over the insulated firebox 14. The throat 16 is in fluid communication with the smoke chamber 12 and the insulated firebox 14. The throat 16 links the smoke chamber 12 and the insulated firebox 14. A divider 18 is positioned within the throat 16 and defines a front air channel 20 and a rear air channel 22 within the throat 16 for air and combustion products rising from the firebox towards the smoke chamber. The separation of the front and rear air channels 20,22 during operation of the fireplace assembly with a firescreen (and with cement finishing panels installed) is better illustrated in FIG. 3.

Figure 2:
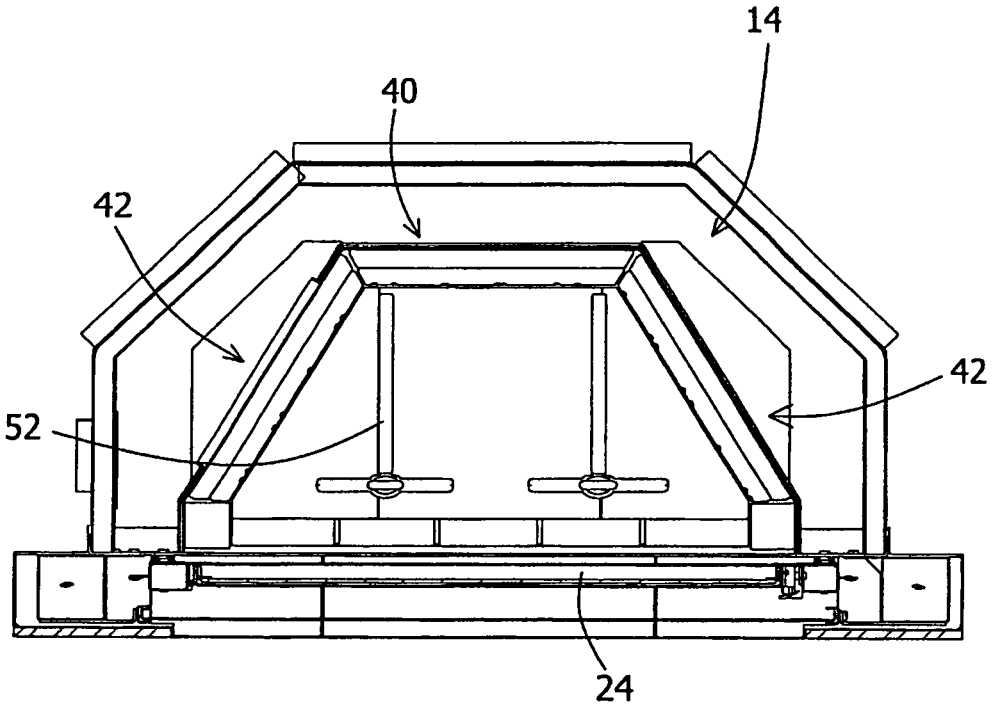
FIG. 2 is a cross-sectional top view of the fireplace assembly shown in FIG. 1.

Preferably, as better shown in FIG. 2, the insulated firebox 14 comprises a rear wall 40 and two sidewalls 42 and each of the sidewalls 42 is positioned at an angle of approximately 120 degrees with respect to the rear wall 40.

Preferably, the throat 16 comprises an inlet 44, an outlet 46 and a curved breast structure 48 positioned between the inlet 44 and outlet 46. The area of the inlet 44 is greater than the area of the outlet 46.

Preferably, the throat inlet 44 is trapezoidal in shape.

Preferably, a bottom area 50 of the smoke chamber 12 is greater than the area of the throat outlet 46.

Preferably, the fireplace assembly 10 further comprises a lip 24 projecting from the bottom of the front opening of the firebox 14.

Preferably, the fireplace assembly 10 further comprises refractory bricks 26 and insulating materials 28 lining the surface of the firebox assembly.

Preferably, as better shown in FIG. 2, the fireplace assembly 10 further comprises a pair of log retainers 52 positioned at a bottom of the firebox 14 with a separation distance of approximately 12" between each log retainer 52 and such that logs placed in the firebox are positioned about 1" lower than the lip 24.

Preferably, the fireplace assembly 10 also comprises a removable guillotine door system 30 covering the front opening of the firebox 14.

Preferably, the fireplace assembly 10 further comprises an air wash system 32 for circulating air down the inner surface of a guillotine glass door when the door system 30 covers the front opening of the firebox Preferably, the firebox 14 has a depth of approximately 13".

Preferably, the rear wall 40 of the firebox 14 has a width of approximately 13½".

In another embodiment of the present invention, as better shown in FIG. 1, the fireplace assembly 10 optionally comprises a catalytic combustor 60 positioned over the rear air channel 22 of the throat 16.

Preferably, the fireplace assembly 10 comprises a chimney outlet 62 positioned in alignment with the throat outlet 46.

The advantages of this fireplace assembly lie in the application of aerodynamic theory to the design of an open fireplace and in the creation of a sustainable hot coal bed under the wood load.

The dimensions of the firebox in particular and of the fireplace in general are such that the air drawn through the firebox is moving in a laminar flow pattern. This laminar flow creates an effective boundary between the fire and the incoming air which forces the flames to stay in a defined area at the back of the hearth area. The laminar flow also stretches the flames upward by starving the fire of air. By limiting the mixing of fire with air, by concentrating the fire in a limited area, by having the flames stretch upward and by positioning the fire in such a way that the flames almost do not touch any surrounding colder surface that would lower the flame temperature, an environment is created which is hot enough and long enough in duration to burn more efficiently volatile gases from the wood load and thus helps particulate emissions when compared to existing designs.

In this application, the primary engine that drives the fire is the coal bed. In clean burning wood stoves and built-in wood stoves, the primary engine is the chimney draft. The dimensions of the hearth and ash lip are such that only a limited amount of air being drawn through the fireplace opening will go to feed the coal bed. Also, the dimensions of the log retainers are such that the wood load is going to sit right on top of the coal bed, thus preventing the coal bed from burning too fast in order to have a sustainable heat source under the wood load. Furthermore, as will be explained in more detail below, materials for construction of the fireplace assembly are chosen in terms of specific thermal and mechanical properties.

Other features of the fireplace assembly according to the present invention that will be detailed hereinafter include:

- Reduction in the amount of air being drawn through the fireplace opening compared to modern fireplace designs, without spillage of smoke back into the room. In a standard modern fireplace, a minimum frontal air velocity needs to be increased to counteract the turbulence and rapid gas expansion occurring in the firebox. In the firebox assembly according to the present invention, with a laminar flow, the minimum frontal air velocity is smaller which means that the firebox and fire are going to remain hotter. There is also the added advantage of having a fireplace that is going to be less susceptible to house depressurization.
- Limited mixing of room air with the flue gases before the smoke chamber, thus promoting a hotter environment inside the firebox.
- High insulation value of the firebox. By insulating the firebox walls, the firebox wall temperature is increased and heat losses are reduced thus limiting cooling of the flame when it touches those surfaces. By insulating the firebox bottom, the coal bed remains hot which promotes a faster start and good volatilization of the wood.
- Trapezoidal throat opening promoting delaying the time it will take for the flame to touch a colder surface.
- High heat reflection coefficient for the firebox walls. The high emissivity of the firebox walls radiates energy back towards the flame which helps maintain its temperature.
- Shallow firebox to make aerodynamics of the system work.
- Tall firebox to accommodate long vertical flames.
- Alignment of the chimney diameter center line with the fireplace throat opening center to prevent smoking at start-up. Hot flue gases naturally rise up vertically. By not interfering with this natural phenomenon, it is possible to have a shallow firebox that does not smoke.
- Alignment of the firebox back with the throat opening back edge.
- Tall ash lip at the front of the fireplace hearth area.
- Two low profile log retainers.
- Turbulence free fireplace opening with smooth transition on the sides and at the top of the opening.
- Curved connection between the fireplace opening top and the throat opening front edge.
- Smoke chamber located above the throat opening. Standard modern fireplaces have the smoke chamber below the throat and part of the firebox. This makes it impossible to have laminar flow with such a configuration.
- Firebox divider below the throat keeping a positive separation between the flue gases and the air. The divider also creates a positive pressure zone below the optional metallic catalytic combustor, thus forcing flue gases into the combustor.
- Alignment between the position of the log retainers and the start of the curved throat to prevent smoke at start-up and to prevent the formation of vertical eddies on each side of the firebox.

Performance Results of the Fireplace Assembly

When tested according to the ASTM protocol, an embodiment of the fireplace assembly according to the present invention in the open door configuration emits about 3.3 g/kg with a burn rate of 4.3 kg/hr. When tested with real cordwood the average emission is 5.1 g/kg with a burn rate of 4.5 kg/hr. Averaging the two results one obtains at least 60% reduction in particulate emissions compared to existing technologies.

This is a substantial reduction in emissions and when compared with the traditional masonry Rumford emission results, it can be safely claimed that the reduction in emission is caused by other factors than the general Rumford shape or design only. However, the Rumford shape was a good starting point in designing our new cleaner open burning fireplace.

Because the fireplace is pre-fabricated, one has a lot more control over the end shape of the fireplace compared to site-built fireplaces. One can take advantage of this by making sure the front opening perimeter is as sharp as possible to prevent the formation of turbulence on the room air being drawn through the opening. This is very important because it is desirable to prevent as much as possible the mixing of this room air with the hot combustible gases burning above the wood load. When there is turbulence, there is a lot less control over the pathway the room air will take before reaching the chimney.

Short Chimney Height

To make the wood burning fireplace assembly according to the present invention a viable alternative to gas fireplaces in modern house constructions, a design of a fireplace that would work with an overall height of 15 feet from the floor to the chimney top was required. This corresponds to an outside wall installation in a single story bungalow without extra chimney bracing above the roof.

The main challenge in such a design is to prevent smoking at start-up when the chimney draft has not yet been established and there is no room air being drawn through the front fireplace opening to carry the smoke to the chimney. Several aspects are to be considered to prevent smoking at start up:

- Knowing that hot gases naturally rise vertically in the atmosphere, it was decided to create a path with no obstruction for the initial smoke to get into the chimney. This is different compared to current designs of clean burning built-in wood stoves where the smoke typically has to go around the firebox baffle before reaching the chimney. To prevent spillage in the current design, the baffle front edge is higher than the front opening and space back inside the firebox in order to create a place for the smoke to accumulate before reaching the chimney.

The log retainers are positioned to force the fireplace user to place the front log at least 3" behind the front opening. Because the throat width is only 13½"" and the side walls of the firebox are opened, there is a zone in the top right and left corner of the front opening where it is easier for the smoke to spill outside the fireplace instead of following the breast before getting inside the smoke chamber.

The throat opening is also centered with the chimney in order to minimize the restriction on the smoke going up. This also increases the performance of the smoke chamber in its role to provide a transition volume for the smoke to accumulate before the chimney draft can take over and swallow the smoke.

Throat and Smoke Chamber Dimensions

When Count Rumford designed his masonry fireplace, the smoke chamber was bigger, with a wider bottom and with a narrow throat. The narrow throat creates the necessary restriction to reduce the amount of room air drawn through the fireplace opening. Because of the laminar air flow, the speed of the air going through the frontal opening can be reduced and still carry the smoke without spillage. The narrow throat and wide smoke chamber bottom were also preventing downdraft from affecting the fire.

Because it is desirable to have a fireplace that works with a very short chimney height, the narrow throat does not perform well. The throat area had to be increased in order to get the proper frontal air speed to prevent spillage. Today, tighter construction and house depressurization problems make the spillage issue with a short chimney even more difficult.

Because similar downdraft problems do not exist with a properly size 10" diameter chimney when compared to masonry chimneys which tend to be bigger in diameter to compensate for the extra friction they generate, the bottom of the smoke chamber is made smaller and the height of the chamber is reduced. This is important in order to have an overall height for the fireplace that allows an installation in a room with an 8 foot ceiling.

Position of the Log Retainers

Compared to usual factory-built open fireplace and also masonry fireplace, the fireplace assembly according to the present invention is about the same width as some existing models but what makes a huge difference is the firebox depth. The 13" depth of the fireplace is comparable to the depth of a gas fireplace.

Manufacturers always account for a bigger depth for wood fireplaces in order to have sufficient room for the coal bed and the wood load. The fireplace assembly according to the present invention being very tall with respect to firebox height, it will be used mostly with a tipi-type of fire.

The ASTM Standard test procedure requires a normal type of fire (with a wood log placed horizontally). The height and position of the log retainers in the fireplace is selected to optimize the results of particulate emissions when using the fireplace with a normal horizontal wood load.

The shape and position of log retainers in the firebox is an important issue with low-depth fireboxes. The retainers are located as close to the front lip as possible to leave maximum room for the wood. The log retainer design is also improved. The vertical part of the log retainer is 1½" thick at its bottom, keeping the wood at least 1½" away from the front ash lip. The reasons for this positioning include:

Avoiding having a wood log too close to the front. Fire too close to the front creates lots of radiation to the floor. The floor might then need supplementary protection (which is a safety testing UL127/ULC-S610 issue).

Helping reduce the amount of flying ashes going on the ash lip top or sticking between the ash lip and the door.

Leaving the exact space for the air flow coming from the air wash during closed door operation of the fireplace.

The horizontal position of the log retainers in the firebox was varied many times during the emission test program. It has been found that a 12" separation distance (inside dimension) is the most effective distance found, for the following reasons:

Since the rear firebox width is 13½", the maximum effective area at the back for the eventual coal bed is used.

When the logs burn, they break apart automatically through the center of firebox keeping a maximum amount of coals in the center. Very high temperature is then concentrated at the center of the firebox. A high temperature of fire contributes to reducing emissions.

Maintaining a high temperature coal bed facilitates a rapid lighting of the next wood load.

Low Profile Log Retainers

Although log position in the firebox has been discussed above, the height of the log retainers is even a more important issue.

Different log retainer heights have been tested. Some heights yield better results in closed door operations while other heights operate well in open door operations. The open door operation was deemed to be more critical.

During the test program, solutions were found to help reduce particulate emissions. The exact height of log retainer was selected based on the following factors:

Low-mass wood burning open fireplaces burn faster than wood stoves and built-in wood stoves. High temperatures improve emission results. A sufficient amount of hot coals between the log retainers is required to quickly light the following wood load.

If the log retainers are a quarter of an inch too high, it is difficult to build an appropriate coal bed to get good emission results. Lots of air enters by the door opening in open door operations. The air coming underneath the fire makes it burn fast and reduces accumulation of coals. The low accumulation of coals renders difficult a proper lighting of the following load. It can work in certain circumstances, but there is a smoking period which should be avoided to obtain good emission test results.

If the log retainers are positioned too low, there is a lack of sufficient air flow underneath the wood load to keep a good high temperature cold bed.

Front Step—Ash Lip

The fireplace assembly is preferably provided with a front ash lip defining the front limit of the hearth door opening side. Both the form and height of the ash lip have an important effect on the primary air flow entering in the fireplace.

During the emission test program, the ash lip design was modified several times. The design has to satisfy marketing requirements and customer service requests while reducing particulate emissions as much as possible. Following factors were considered:

A high ash lip allows a bigger space in the hearth for the coals and ashes to accumulate, but reduces a percentage of the opening area, which is an important issue from a marketing standpoint. At the same time, the ash lip would be too much visible by a user.

A low ash lip would not allow enough space in the hearth for accumulation of coals and ashes. Ashes and coals can also pass over the lip and dirty the bottom of the glass door. Ashes would also stick and accumulate underneath the door thus possibly creating an air entrance under the door.

A narrow lip is too fragile from a structural standpoint.

A wide lip keeps ashes and coals farther from the window but decrease the hearth area.

However, during the emission test program, it was discovered that the shape of the ash lip is more critical than just an aesthetic issue. The ash lip has a very important role for the combustion air flow. This air flow circulates very differently between open-door operations and closed-door operations. Satisfying the aesthetic and functionality requirements is a challenge.

In closed-door operations, all the combustion air comes from the air wash. Air is descending along the glass door (to keep it clean) and hits the front ash lip before getting to the fire. In order to get a good hot fire, air flow is directed underneath the wood logs on the log retainers. The combination of the correct air flow, the ash lip shape and the height of log retainers contribute to increase the temperature of the coal bed and thus creates a good combustion with lower emissions.

In open door operations (with firescreen), the air wash system has no effect. All the air coming through the door opening pushes the fire towards the rear of the firebox. The ash lip shape becomes an important specification in this operational mode. A small part of the air flow is directed underneath the wood logs on the log retainers. A proper ash lip shape provides the right amount of air to keep a low coal bed at high temperature during all operational phases. It helps maintain high temperature to reduce emissions. Keeping the fire at a high temperature in open door operations with a big door opening is a big challenge, and the shape of the lip helps maintain this high temperature.

Insulated Firebox & High Heat Reflection of the Firebox

Since the firebox design according to the present invention differs from traditional/usual designs for either a stove (or prefabricated built-in wood stoves) or an open prefabricated fireplace, the traditional/usual solutions for a clean burning fire could not be used.

Traditional stove fireboxes are low in height with a baffle at the top in order to keep as much heat in the firebox and with the introduction of additional (secondary) air, with unburned combustion gases burned at the level of the secondary air. The firebox design according to the present invention differs significantly from that of a firebox stove: it is high and wide but shallow. In a traditional fireplace design, most of the heat is lost into the chimney, leaving nothing for a secondary combustion.

To have a clean burning fireplace, a significant amount of heat is required throughout all three phases of the fire:

1. Startup Phase, 30 minutes
2. Hot Fire Phase, 1-2 hours
3. Charcoal Phase, 30-60 minutes The design of the fireplace captures and keeps in the firebox as much heat as possible as quickly as possible.

The design uses an internally insulated firebox. This reduces heat losses that usually radiate out through the walls and bottom of the firebox. This insulated firebox actually serves two purposes: 1) it keeps the firebox hot to promote a clean burn and 2) it limits the heat radiated to the combustible materials surrounding the fireplace for easier safety testing. To the Applicant's knowledge, no unit currently on the market has an internally insulated firebox.

Unfortunately, insulation is not sufficient. Once the heat is trapped in the firebox, it can still escape through the chimney. Since the design of the firebox according to the present invention does not use a traditional baffle, it was decided to use refractory bricks as a thermal mass to capture the heat during phases 1 and 2 of the fire and then release this heat during phase 3 to maintain the necessary heat level for a clean burn. This thermal mass is also useful for regulating the firebox temperature during phase 2 of the burn.

In order to save testing time, a thermodynamics simulator was used based on an early 3D firebox design. With the use of such a tool, it was possible to compare the temperatures calculated for the inside and outside of the firebox, given the same conditions when using different materials for the refractory bricks and for the internal insulation. It was thus possible to compare:

1. current RSF™ refractory bricks
2. current ICC™ insulation material
3. better low density refractory bricks
4. better medium density refractory bricks
5. better high density refractory bricks
6. better insulation material Different simulation scenarios were tested in order to identify the best combination. One of these scenarios showed that it was possible to retain up to 45% more heat in the firebox instead of losing all that heat to radiation through the firebox sides. Based on these results, the entire inside of firebox is covered with insulating material, and then covered with medium or high density refractory bricks.

Metal Catalytic Combustor, No Bypass and Segregation of Room Air and Heated Air

To further lower the potential emissions produced by this new fireplace, a metal catalytic combustor may be used. Metal catalytic combustors are common in the industrial world (automotive industry, self-cleaning ovens, etc.) but are rarely used on fireplaces or stoves. The advantages of a metal combustor are the following:

Lower ignition temperature: requires less heat to start and maintain the catalytic reaction than a ceramic catalytic combustor Less susceptible to cracking due to thermal expansion or shock: essentially since flames could touch the catalytic combustor. The flames would eat through a ceramic catalytic combustor.

Metal catalytic combustors should not require cleaning as often as a ceramic model: since flames can get high enough to touch the catalytic combustor, they will clean the intake surface of the catalytic combustor.

Lab tests have revealed that having a catalytic combustor sized to cover the whole throat opening is not a viable solution since the catalytic combustor represents too much of a restriction and causes smoke to spill outside the firebox when burning the fireplace with an open door or when opening the door to add wood. This is why a bypass mechanism is usually part of a catalytic fireplace or stove.

Taking advantage of an understanding of the Rumford shape and the thermodynamics involved, it was possible to modify the throat in order to be able to use a catalytic combustor without the usual bypass mechanism. The depth of the throat was enlarged to be able to offer enough depth for the catalytic combustor at the back of the throat opening and free opening at the front. Since air always goes through the least resistive path, having a free opening just in front of the catalytic combustor without anything to prevent the hot gases from going through the free opening would mean that none of the gases would go through the catalytic combustor.

Given that room air entering at the top of the firebox opening follows the curvature of the throat, and would potentially dilute and cool down the combustion gases, a divider was added to segregate cold room air through the free opening at the front of the throat and combustion gases at the back. This divider is long enough to maintain this segregation without provoking smoke spillage into the room. If combustion gases do back up from going through the catalytic combustor, they will be pulled up through the free opening with the room air instead of spilling out.

Further testing of the new fireplace without a catalytic combustor revealed that the divider is not only useful to keep cold room air from diluting the heated air before going trough the catalytic combustor but it serves the same purpose without the presence of the catalytic combustor. Emission testing has revealed that when the unit is burned with a firescreen, the presence or the absence of the catalytic combustor does not make a big difference. However the presence or the absence of the divider does make a difference. It gives more time to the combustion gases to finish burning before being cooled by the room air.

All the modifications that were incorporated under the assumption that they were necessary for the catalytic combustor have been shown to be a good addition for a non catalytic combustor unit also. The unit can be used with or without the catalytic combustor and take advantage of all these features.

Alignment of the Chimney with the Back of the Throat

In earlier designs of the present invention, the smoke chamber was similar to traditional Rumford designs. In order to limit the overall depth of the fireplace, the smoke chamber was wider towards the front of the fireplace than towards the back. From the perspective of the smoke chamber, such a design could have worked but it implied that the chimney was not centered over the throat opening. If one assumes a normal distribution of gases throughout the throat opening, the position of the chimney would thus create a bottleneck in gas flow. This phenomenon was observed when doing burn tests using an early prototype in a laboratory. The bottleneck was so great that smoke would spill out of the fireplace intermittently.

Along with other design changes, the throat and smoke chamber were redesigned to smooth out the path of gases in the fireplace. The chimney was realigned so that the center of the chimney would coincide with the center of the throat opening, making the path of least resistance the area were most of the gases pass anyway.

Almost-Sealed Glass Door and Air Wash for Maintaining a Clean Glass Surface

Although the fireplace according to the present invention is aimed at a market that usually comprises open fireplaces, it is desirable to offer a fireplace not only with a firescreen but also with a glass door for the two following reasons.

Firstly, traditional prefabricated fireplaces are sold with a firescreen and sometimes offer as an option a glass door which uses a tempered glass. It is desirable to offer a glass door as part of the unit in order to be able to offer a "greener than green" fireplace alternative to standard fireplaces. Even though everything in the present design has been chosen to minimize the emissions from the fireplace when it is burned with a firescreen, it was known that emission performance would be even better with a glass door.

Secondly, one of the greatest disadvantages of a traditional open fireplace is the fact that a lot of room air goes up in the chimney. The Rumford design tackles this exact phenomenon but it only reduces the amount of room air that goes up the chimney. There is still a lot of room air going up the chimney. Much less air is drawn from the room when you burn a fireplace with a closed door. In cold climates, burning a fireplace with a closed door offers big energy savings.

To design an appropriate glass door configuration for the fireplace, recent experience with sealed door fireplaces was useful. It was known that trying to pass safety testing with the new fireplace would be impossible with tempered glass so a ceramic glass was chosen because ceramic glass can sustain higher operational temperature than traditional tempered glass. Unfortunately, ceramic glass is very expensive compared to tempered glass. Ceramic glass can be the single most expensive item of the entire fireplace.

A first design of the glass door used a hinged door in order to be able to have a completely sealed door. It works fine and it is possible to adjust the air wash to keep the entire glass clean.

However, because of the size of the glass door and for safety reasons, it was decided to design also a guillotine system for both the door and the firescreen. With this guillotine system, the end-user can use the firescreen and the glass door one after the other without having a structure projecting out into the room such as a hot open glass door while using the firescreen. Even though the glass door opens through an up and down motion of the guillotine system, the glass can be also opened along a hinge to allow for glass cleaning. The glass is thus mounted in a glass frame. The glass frame is attached to the door frame through a hinge. The door frame is attached to the guillotine system.

Irrelevant of the door system (hinged or guillotine), having such a big glass door potentially means a big dirty glass if no special system is provided to keep the glass clean. This is a problem that is well known for the built-in wood stoves but totally unknown to standard fireplaces. Furthermore, the problem is much more serious in this case because of the height of the glass door. The glass door in an embodiment of the present invention is more than 30" high compared to high performance fireplaces that are usually less than 20" high. Therefore, a special air wash system was designed which combines a symmetrical distribution of air with a well calibrated air wash delivering system. The air wash system uses cold air coming from below the firebox level, delivers just enough cold air in front of the glass with just enough speed to keep this cold air going all the way down to the bottom of the firebox. By doing so, the air wash protects the entire glass from condensation of combustion gases on its inner surface. The air wash system comprises a series of different chambers connected by holes of various sizes enabling a symmetrical delivery of air.

While burning with a closed door, one has to understand that the only combustion air coming into the firebox, is the air from the glass air wash. The air is coming in at the top of the glass, at the very front of the firebox, and because it is cold, it will descend. At the bottom of the glass, the front step represents an obstacle for this cold air. The primary air will thus lose almost all of its velocity when it will hit the front step. The combustion of the cordwood happening in the firebox will create a depressurization that will suck the cold air from behind the front step and into the flames to maintain the combustion going. This is why calibration of the air wash is most important.

If there is too much air, it could spill onto the coal bed with too much velocity and it would burn it too rapidly. It is very difficult to maintain a good fire when there is no coal bed. It could also pose a safety issue by increasing the burn rate to a level that would not respect safety standards (ULC-S610, UL-127)

If there is not enough air, the fire could be missing combustion air. It could burn at too low a temperature to produce low emission levels. It could also die on itself.

If there is enough air but not enough velocity, the air could warm up before it reaches the bottom of the glass and go up into the flame and into the chimney without protecting the entire glass. One would then end-up with a good clean fire but with a big dirty glass.

Modes of Operation

Here is a short list of main differences when burning the unit either with a closed door or with a firescreen (open door).

| Burning with a closed door | Burning with a firescreen (open door) |
|---|---|
| Keeps the heat in the room | Most of the heat goes in the chimney |
| Do not hear most of the crackling sound made by the burning wood | Hear all of the crackling sound made by the burning wood |
| Keeps the room air in the room | A fair amount of room air goes up the chimney |
| Lower particulate emissions | Higher particulate emissions |

Since it is very easy to go from the closed door to the firescreen and then to the closed door again and vice-versa, the end-user may be tempted to go from one to the next depending on the desired result.

We thus end-up with a variety of modes of operation:

1. Burn the unit with the firescreen
2. Burn the unit with a closed door
3. Start with the firescreen, then with the closed door
4. Start with the closed door then with the firescreen
5. Start with the firescreen, then with the closed door, then with the firescreen again
6. Start with the closed door then with the firescreen, then with the closed door again
7. Any other combination of modes.

To simplify, the two main modes of operation will be described. The other modes can be deduced based on these two.

Burning with a Firescreen

When preparing to start a fire, it is recommended put some paper on the firebox floor just under the log retainers. Kindling (small dry wood) will be then placed on the log retainers. The fire can then be light. Once the kindling is burning well, a couple of small cordwood logs can then be added. Once a coal bed has been established, standard cordwood is to be added on a regular basis to maintain the desired level of fire and radiated heat.

While burning with an open door, one has to understand that the combustion air is not controlled in any way. Air is coming in through the entire firescreen. The front step is most important to maintain a good level of heat at the firebox floor level.

At the startup phase (30 minutes), the entire firebox is cold (at ambient temperature). When lighting the paper with the kindling, the idea is to generate as much heat as possible to pre-heat the bottom of the firebox and start the chimney draft. In a matter of minutes, this goal will be achieved with the help of the chosen refractory bricks and insulation. The bottom of the firebox is covered with high density firebrick to increase the heat retention. The firebox floor is already pre-heated when the small cordwood is added, and it starts burning the very instant it is added. The front step or lip protects the coal bed that is starting to establish itself from being burned too quickly by minimizing the velocity of the air going in low in the firebox. The Rumford shape of the fireplace will play its part by pushing the flames backwards. The flames will thus start heating up the back wall of the firebox. The divider installed in the throat segregates the heated air from the cold room air. This helps in establishing the chimney draft during this first phase as well as keeping the combustion gases as hot as possible.

Once the fire is established enough to add standard cordwood, the fire enters the second phase: the hot fire phase (1-2 hours). As additional cordwood is added, the flames pushed back by the Rumford shape of the fireplace will heat the whole firebox. Equilibrium will be established between the cold room air going into the firebox and cooling it down, and the hot flames heating it. Depending on the amount of cordwood, the rate at which it is added, the heated portion of the firebox versus the cooled portion will be different. In any case, the front step or lip will protect the coal bed to maintain the amount of heat necessary for a clean and a continuous combustion even when cold wood is added. The height of the log retainers plays a major role during this phase. If they are too high, the coal bed will be too far from the cordwood to maintain itself and help in the cordwood combustion. If it is too low, the coal bed will then suffocate and lose all of it usefulness. Again the divider installed in the throat segregates the heated air from the cold room air.

When no more cordwood is added and the fire is left to fend for itself, the fire enters the charcoal phase (last 30-60 minutes). From this point on, the equilibrium—between the cold room air going into the firebox and cooling it down and the hot flames heating it—is broken. The flames are dying and the firebox will slowly be cooled by the room air. The chosen refractory bricks and insulation will start giving back the heat they have stored. This will maintain the fire going longer than usual at this point. The front step or lip also continues to protect the coal bed and helps generate a good level of heat.

Burning with a Closed Door

When preparing to start a fire, it is suggested to put some paper on the firebox floor just under the log retainers. Kindling (small dry wood) will be then placed on the log retainers. The fire can then be light. Once the kindling is burning well, a couple of small cordwood logs can then be added and the door can be closed. Once a coal bed has been established, standard cordwood is to be added on a regular basis to maintain the desired level of fire and radiated heat.

While burning with a closed door, it should be remembered that the only combustion air coming into the firebox is the air from the glass air wash. Since the combustion air is reduced compared to burning with a firescreen, the same fire will burn hotter and will generate lower particulate emissions.

At the startup phase (30 minutes), the entire firebox is cold (at ambient temperature). When lighting the paper with the kindling, the idea is to generate as much heat as possible to pre-heat the bottom of the firebox and start the chimney draft. In a matter of minutes, this goal will be achieved with the help of the chosen refractory bricks and insulation. The bottom of the firebox is covered with high density firebrick to increase the heat retention. The firebox floor is already pre-heated when the small cordwood is added, and it starts burning the very instant it is added. The door can be closed at this point. As soon as the door is closed, the fireplace will not burn the same as if the door was open (with a firescreen). The front step or lip still protects the coal bed that is starting to establish itself from being burned too quickly by minimizing the velocity of the air coming down from the air wash. The Rumford shape of the fireplace does not play a role with the door closed. The flames will start heating up the entire firebox. The divider installed in the throat still segregates the combustion air from the warmed air wash air but the effect is less important with the door closed. Since there is less dilution of the heated air going into the chimney, the chimney draft will establish itself faster.

Once the fire is established enough to add standard cordwood, the fire enters the second phase: the hot fire phase (1-2 hours). As additional cordwood is added, the flames continue to heat the whole firebox. Again equilibrium will be established between the cold air wash going into the firebox and cooling it down and the hot flames heating it but it is a totally different equilibrium point than when the fireplace is burned with an open door. Depending on the amount of cordwood, the rate at which it is added, the heated portion of the firebox versus the cooled portion will be different. In any case, the front step or lip will protect the coal bed to maintain the amount of heat necessary for a clean and a continuous combustion even when cold wood is added. The height of the log retainers plays a major role during this phase. If they are too high, the coal bed will be too far from the cordwood to maintain itself and help in the cordwood combustion. If it is too low, the coal bed will then suffocate and lose all of it usefulness.

When no more cordwood is added and the fire is left to fend for itself, the fire enters the charcoal phase (last 30-60 minutes). From this point on, the equilibrium—between the cold air wash going into the firebox and cooling it down and the hot flames heating it—is broken. The flames are dying and the firebox will slowly be cooled by the air wash. The chosen refractory bricks and insulation will start giving back the heat they have stored. This will maintain the fire going longer than usual at this point and even longer with the door closed. The front step or lip continues also to protect the coal bed and helps generate a good level of heat.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A fireplace assembly comprising:

an insulated firebox having a front opening, said front opening defining a front access plane substantially parallel to a rear wall of the firebox;

a smoke chamber positioned over the insulated firebox;

a throat positioned over the insulated firebox, the throat being in fluid communication with the smoke chamber and the insulated firebox, and the throat linking the smoke chamber and the insulated firebox; and a divider positioned within said throat, said divider positioned upward and rearward of the front opening of the firebox, said divider being substantially parallel to said front access plane and defining an unobstructed front air channel and an unobstructed rear air channel within the throat for promoting laminar flow, through both front and rear air channels, of air and combustion products rising from the firebox towards the smoke chamber, and the divider promoting flow of air and combustion products through the front air channel having a lower temperature than a temperature of the flow of air and combustion products through the rear air channel.

2. The fireplace assembly according to claim 1, wherein the insulated firebox further comprises two sidewalls and each of the sidewalls is positioned at an angle of approximately 120 degrees with respect to the rear wall.

3. The fireplace assembly according to claim 2, wherein the rear wall of the firebox has a width of approximately 13½".

4. The fireplace assembly according to claim 2, wherein the throat comprises an inlet, an outlet and a curved breast structure positioned between the inlet and outlet, and an area of the inlet is greater than an area of the outlet.

5. The fireplace assembly according to claim 4, further comprising a lip projecting from a bottom of the front opening of the firebox.

6. The fireplace assembly according to claim 5, further comprising a pair of log retainers positioned at a bottom of the firebox with a separation distance of approximately 12" between each log retainer and such that logs placed in the firebox are positioned about 1" lower than the lip.

7. The fireplace assembly according to claim 6, further comprising a removable guillotine door system covering the front opening of the firebox.

8. The fireplace assembly according to claim 7, further comprising an air wash system for circulating air down an inner surface of a guillotine glass door when the door system covers the front opening of the firebox.

9. The fireplace assembly according to claim 4, wherein the throat inlet is trapezoidal in shape.

10. The fireplace assembly according to claim 1, wherein the throat comprises an inlet, an outlet and a curved breast structure positioned between the inlet and outlet, and an area of the inlet is greater than an area of the outlet.

11. The fireplace assembly according to claim 10, wherein the throat inlet is trapezoidal in shape.

12. The fireplace assembly according to claim 10, wherein a bottom area of the smoke chamber is greater than the area of the throat outlet.

13. The fireplace assembly according to claim 10, further comprising a chimney outlet positioned in alignment with the throat outlet.

14. The fireplace assembly according to claim 1, further comprising a lip projecting from a bottom of the front opening of the firebox.

15. The fireplace assembly according to claim 14, further comprising a pair of log retainers positioned at a bottom of the firebox with a separation distance of approximately 12" between each log retainer and such that logs placed in the firebox are positioned about 1" lower than the lip.

16. The fireplace assembly according to claim 1, further comprising refractory bricks and insulating materials lining an inside surface of the firebox assembly.

17. The fireplace assembly according to claim 1, further comprising a removable guillotine door system covering the front opening of the firebox.

18. The fireplace assembly according to claim 17, further comprising an air wash system for circulating air down an inner surface of a guillotine glass door when the door system covers the front opening of the firebox.

19. The fireplace assembly according to claim 1, wherein the firebox has a depth of approximately 13".

20. The fireplace assembly according to claim 1, further comprising a catalytic combustor positioned over the rear air channel of the throat.

* * * * *